US006978094B2

(12) United States Patent
Miyasaka et al.

(10) Patent No.: US 6,978,094 B2
(45) Date of Patent: Dec. 20, 2005

(54) IMAGE FORMING APPARATUS WITH A TONER DENSITY SENSOR

(75) Inventors: Yutaka Miyasaka, Hachioji (JP); Kimio Nishizawa, Hachioji (JP); Nobuyasu Tamura, Hachioji (JP); Kazutoshi Kobayashi, Hachioji (JP); Eiji Nomura, Hachioji (JP)

(73) Assignee: Konica Corporation, Tokyo (JP)

( * ) Notice: Subject to any disclaimer, the term of this patent is extended or adjusted under 35 U.S.C. 154(b) by 20 days.

(21) Appl. No.: 10/648,492

(22) Filed: Aug. 25, 2003

(65) Prior Publication Data

US 2004/0156648 A1 Aug. 12, 2004

(30) Foreign Application Priority Data

Aug. 30, 2002 (JP) ..... 2002-253176

(51) Int. Cl.[7] ..... G03G 15/10
(52) U.S. Cl. ..... 399/62; 399/63
(58) Field of Search ..... 399/61–64, 254, 399/258

(56) References Cited

U.S. PATENT DOCUMENTS 6,104,892 A * 8/2000 Kobayashi et al. ..... 399/63
6,249,664 B1 * 6/2001 Sato ..... 399/254
6,473,584 B1 * 10/2002 Hibino et al. ..... 399/254

FOREIGN PATENT DOCUMENTS

JP 07253705 A * 10/1995 ..... G03G 15/08

* cited by examiner

*Primary Examiner*—Arthur T. Grimley
*Assistant Examiner*—Ryan Gleitz
(74) *Attorney, Agent, or Firm*—Cohen, Pontani, Lieberman & Pavane

(57) ABSTRACT

This invention relates to an image forming apparatus including a developing unit which develops an electrostatic latent image formed on an image carrier by using a two-component developing agent containing polymerized toner. The developing unit includes a supply/convey member which conveys the two-component developing agent in the axial direction while agitating it and a toner density sensor which detects the toner density of the two-component developing agent. The toner density sensor is placed to be in a non-contact state with respect to the supply/convey member and oppose it with a gap of 0.8 mm or less. The diameter of the supply/convey member is set to 23 mm or more.

6 Claims, 9 Drawing Sheets

IMAGE FORMING APPARATUS WITH A TONER DENSITY SENSOR

BACKGROUND OF THE INVENTION

1. Field of the Invention

The present invention relates to an image forming apparatus such as a copying machine, printer, or facsimile apparatus which uses electrophotography and, more particularly, to an image forming apparatus which performs image formation using a two-component developing agent.

2. Description of the Prior Art

As a developing agent for developing an electrostatic latent image formed on an image carrier, a two-component developing agent formed from a mixture of nonmagnetic toner particles and magnetic carrier particles is suitably used.

Recently, in order to realize high image quality and high durability, toner particles have been reduced in diameter, and toner with high sphericity such as polymerized toner have been used. When such toner is used, a high-resolution, high-fidelity image can be obtained. On the other hand, toner scattering and fog tend to occur. As a measure against this problem, a technique of also reducing carrier particles in diameter has been used. However, reducing the carrier particle diameter makes it difficult to mix replenished toner with a developing agent. As a consequence, scattering of insufficiently charged toner and fog tend to occur.

In order to prevent toner scattering and fog, as disclosed in Japanese Unexamined Patent Publication No. 1-166073, it is necessary to sufficiently agitate toner and a carrier and keep the toner density of a developing agent (the mixing ratio between toner particles and carrier particles) constant. For this purpose, a toner density sensor is used to detect a toner density by detecting the permeability of a developing agent agitated in a developing device, and the detected output is compared with a predetermined threshold, thereby replenishing toner.

A convey member for conveying a developing agent while agitating it with a conveyor screw is used to sufficiently agitate toner and a carrier so as to obtain a charged state by mutual friction between the toner and the carrier.

The toner density sensor is placed to oppose the convey member, which agitates/conveys a developing agent, so as to detect a toner density. To prevent toner scattering and fog, high-precision toner density control is required. However, as the carrier particle diameter decreases, the fluidity of the developing agent decreases. This has greatly degraded the substantial toner density controllability of the toner density sensor, resulting in worsening the problems of toner scattering and fog.

SUMMARY OF THE INVENTION

It is an object of the present invention to provide an image forming apparatus which can accurately detect a toner density by using a toner density sensor placed to oppose a convey member.

In order to achieve the above object, according to the first aspect of the present invention, there is provided an image forming apparatus including developing means for developing an electrostatic latent image on an image carrier by using a two-component developing agent containing polymerized toner, the developing means comprising a convey member in the form of a spiral screw which conveys the two-component developing agent in an axial direction while agitating the developing agent, and a toner density sensor which is placed to oppose the convey member and detects a toner density of the two-component developing agent, wherein the convey member has a diameter of not less than 23 mm.

In order to achieve the above object, according to the second aspect of the present invention, there is provided an image forming apparatus including developing means for developing an electrostatic latent image on an image carrier by using a two-component developing agent containing polymerized toner, the developing means comprising a convey member in the form of a spiral screw which conveys the two-component developing agent in an axial direction while agitating the developing agent, and a toner density sensor which is placed to oppose the convey member and detects a toner density of the two-component developing agent, wherein a relationship between an carrier average particle diameter Rc ($\mu$m) of the two-component developing agent and a diameter Rh (mm) of the convey member satisfies:

$$Rh \geqq -0.0891 \times Rc + 26.008$$

In order to achieve the above object, according to the third aspect of the present invention, there is provided an image forming apparatus including developing means for developing an electrostatic latent image on an image carrier by using a two-component developing agent containing polymerized toner, the developing means comprising a convey member in the form of a spiral screw which conveys the two-component developing agent in an axial direction while agitating the developing agent, and a toner density sensor which is placed to oppose the convey member and detects a toner density of the two-component developing agent, wherein a relationship between a carrier average particle diameter Rc ($\mu$m) of the two-component developing agent and a head diameter Rs (mm) of the toner density sensor opposing the convey member satisfies $$Rs \leqq 0.13333 \times Rc + 1.3333$$

The respective aspects described above have the following secondary aspects.

First of all, when the convey member has a screw pitch of 16 to 35 mm, a rotational speed of the convey member is 3 to 10 rps.

In addition, the toner density sensor comprises a sensor which detects a change in permeability.

Furthermore, a perpendicular bisector of a head surface of the toner density sensor passes through a central axis of the convey member.

Moreover, the convey member is in a non-contact state with respect to the head surface of the toner density sensor, and a gap therebetween is not more than 0.8 mm.

As is obvious from the respective aspects described above, according to the present invention, in an image forming apparatus using a developing agent containing polymerized toner with a small particle diameter, high-precision toner density detection is performed, so that the toner density is managed within a predetermined toner density range, and a high-quality image can be obtained without causing any toner scattering and fog.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

An image forming apparatus to which a developing unit according to the present invention is applied will be described first with reference to FIG. 1.

A color image forming apparatus according to an embodiment of the present invention is a tandem type color image forming apparatus designed to form, on a plurality of image carriers, toner images formed from yellow (Y), magenta (M), cyan (C), and black (K) toners, and superimpose the formed toner images on a transfer member through an intermediate transfer member or directly.

Figure 1:
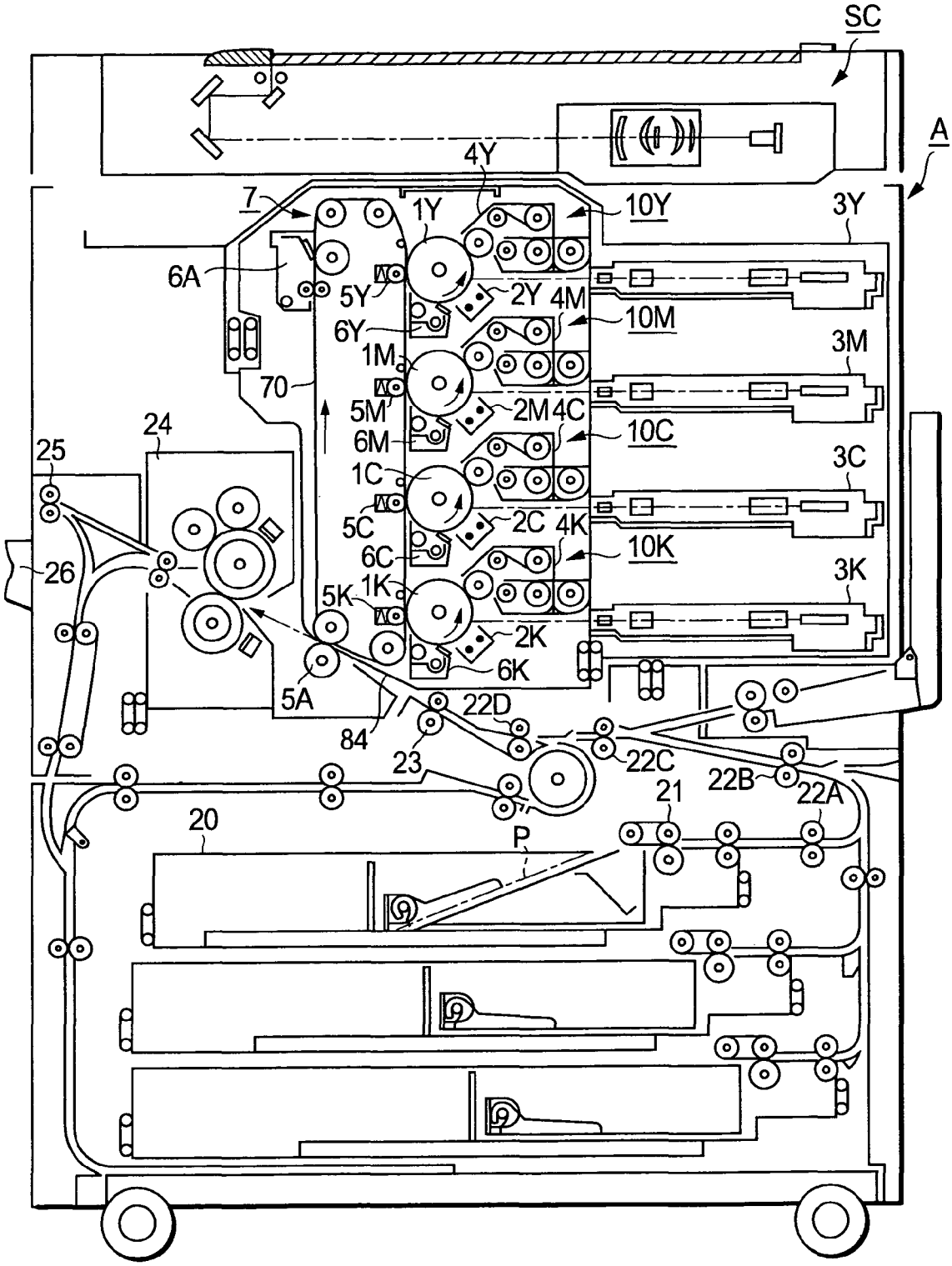
FIG. 1 is a schematic sectional view of a color image forming apparatus according to the present invention.

The color image forming apparatus shown in the sectional view of FIG. 1 is called a tandem type color image forming apparatus designed to superimpose and transfer toner images formed on image carriers onto an intermediate transfer member and transfer the superimposed toner images at once. This apparatus is comprised of a plurality of image forming sections 10Y, 10M, 10C, and 10K, an intermediate transfer unit 7, a paper feed/convey section (denoted by no reference numeral), and a fixing unit 24. An original image reader SC is placed on an image forming apparatus body A.

The image forming section 10Y for forming yellow images includes a charging device 2Y, exposure device 3Y, developing unit 4Y, primary transfer section 5Y, and cleaning device 6Y which are arranged around an image carrier (photosensitive body) 1Y. The image forming section 10M for forming magenta images includes an image carrier (photosensitive body) 1M, charging device 2M, exposure device 3M, developing unit 4M, primary transfer section 5M, and cleaning device 6M. The image forming section 10C for forming cyan images includes an image carrier (photosensitive body) 1C, charging device 2C, exposure device 3C, developing unit 4C, primary transfer section 5C, and cleaning device 6C. The image forming section 10K for forming black images includes an image carrier (photosensitive body) 1K, charging device 2K, exposure device 3K, developing unit 4K, primary transfer section 5K, and cleaning device 6K.

In each image forming section 10, charging, exposure, and development are performed to form an image of a corresponding color on an image carrier 1.

The intermediate transfer unit 7 has an intermediate transfer member 70 in the form of a semiconductive endless belt which is wound around a plurality of rollers so as to be pivotally held.

The images of the respective colors formed by the image forming sections 10Y, 10M, 10C, and 10M are sequentially superimposed in synchronism with each other to be transferred on the intermediate transfer member 70 which pivots through the primary transfer sections 5Y, 5M, 5C, and 5K, thereby forming a composite color image. A recording medium (to be referred to as a paper sheet hereinafter) P stored in a paper feed cassette 20 is fed by a paper feed device 21 and conveyed to a secondary transfer section 5A through a plurality of intermediate rollers 22A, 22B, 22C, and 22D and registration rollers 23. As a consequence, the superimposed color images are transferred onto the paper sheet P at once. The paper sheet P on which the color images are transferred is subjected to fixing processing by the fixing unit 24. This paper sheet is then clamped by paper discharge rollers 25 and placed onto a paper discharge tray 26 located outside apparatus.

After the secondary transfer section 5A transfers the color images onto the paper sheet P, a cleaning device 6A removes residual toner from the intermediate transfer member 70 from which the paper sheet P was curvature-separated.

During image formation processing, the primary transfer section 5K is always pressed against the image carrier 1K. The remaining primary transfer sections 5Y, 5M, and 5C are respectively pressed against the image carriers 1Y, 1M, and 1C only during color image formation.

The secondary transfer section 5A is pressed against the intermediate transfer member 70 only when the paper sheet P passes through the secondary transfer section 5A and secondary transfer is performed.

Figure 2:
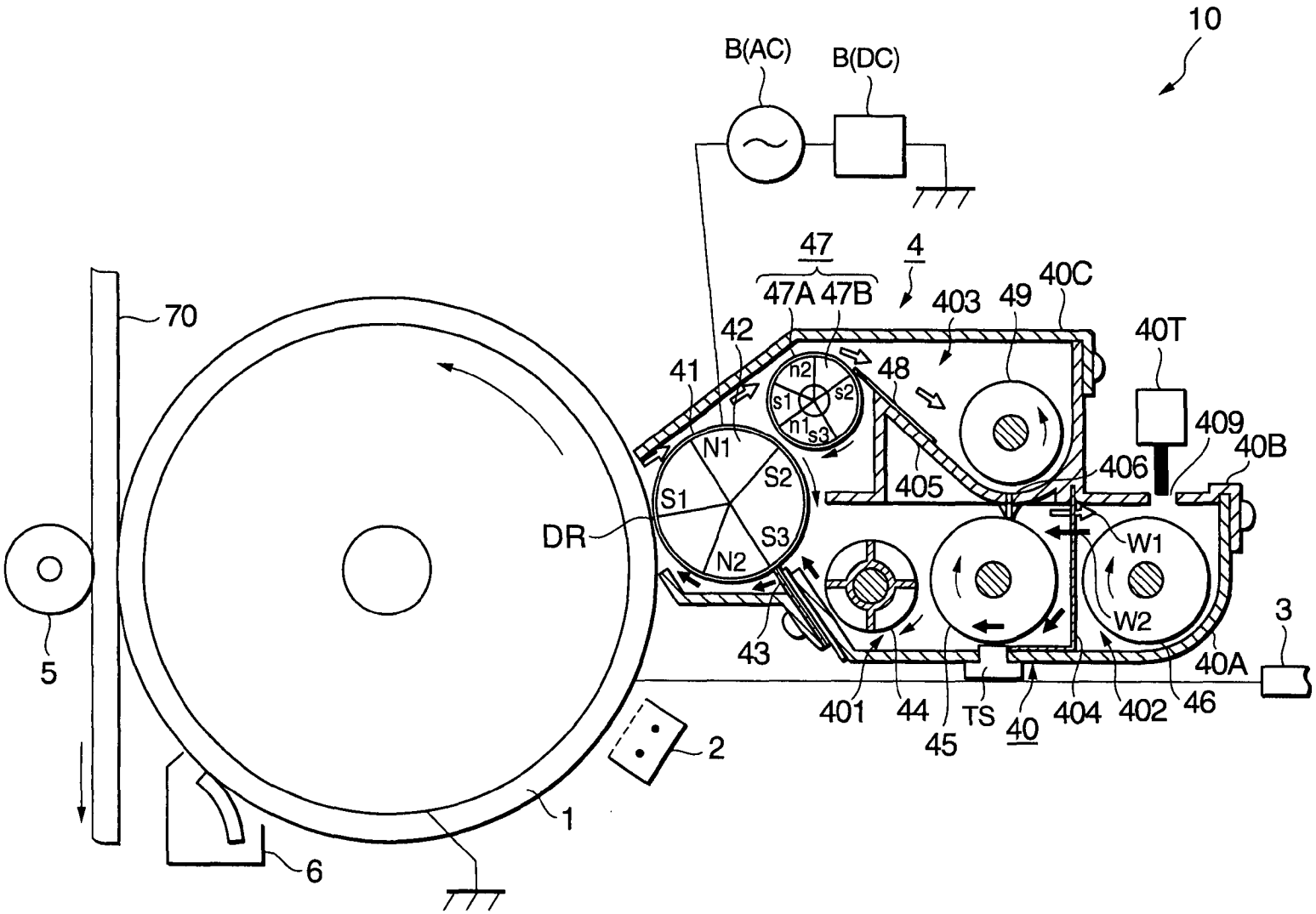
FIG. 2 is a sectional view of an image forming section in the color image forming apparatus according to the present invention.

FIG. 2 shows one image forming section 10. An OPC photosensitive body or the like is used as the drum-like photosensitive body 1 serving as an image carrier which rotates in the direction indicated by the arrow. The photosensitive body 1 is uniformly charged by a charging device 2 using a scorotron charger or the like. As an exposure device 3, an exposure medium designed to perform dot exposure, e.g., a laser or light-emitting diode, is used. An electrostatic latent image is formed by image exposure performed by the exposure device 3. Following such a latent image forming process, development is performed by a developing unit 4 (to be described in detail later). The resultant electrostatic latent image becomes a toner image. The photosensitive body 1 and developing unit 4 are driven by a motor as a single driving device in this embodiment. However, the present invention is not limited to this, and the image carrier 1 and developing unit 4 may be driven by different driving devices.

Figure 3:
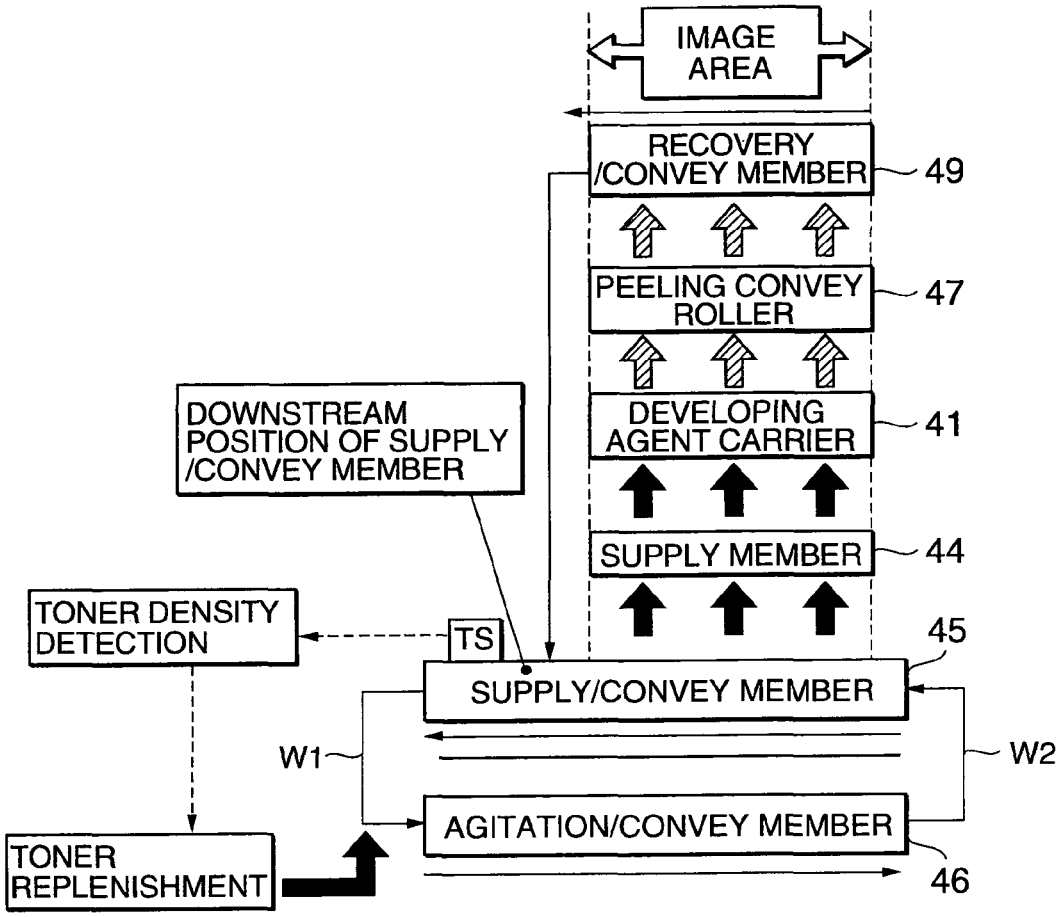
FIG. 3 is a view for explaining the flow of a developing agent.

The developing unit 4 is comprised of a developing device frame member 40, a developing agent carrier 41 formed from a developing roller, a magnetic field generator (magnet roll) 42, a restriction member 43 formed from a spike cutting plate, a turbine type supply member 44, a supply/convey member 45 (to be also referred to as a first conveyor screw hereinafter) formed from a spiral screw, an agitation/convey member 46 formed from a spiral screw, a peeling convey roller 47, a peeling plate 48, a recovery/convey member (to be also referred to as the second conveyor screw hereinafter) 49 formed from a spiral screw, and the like. The developing unit 4 is driven by the same motor, serving as a driving device, as that for the photosensitive body 1. FIG. 3 is a view for explaining the flow of a developing agent.

The developing agent carrier 41 is placed to oppose the photosensitive body 1 and rotatably supported. The developing agent carrier 41 rotates in the direction indicated by the arrow to convey a developing agent to a development nip portion DR, and carries the developing agent at the development nip portion DR to form a developing agent layer necessary for development.

A supply section 401 includes the rotatable turbine type supply member 44 which supplies a developing agent to the developing agent carrier 41. The supply section 401 uniformly supplies the developing agent conveyed from the supply/convey member 45 to a developing agent reception magnetic pole S3 of the developing agent carrier 41. Note that the supply member 44 may be a spiral screw having a function of conveying a developing agent in the rotation axis direction.

The supply/convey member 45 is placed parallel on the supply section 401 and conveys the developing agent conveyed from the agitation/convey member 46 to the supply section 401 while conveying the developing agent in the rotation axis direction.

The agitation/convey member 46 mixes and agitates replenished new toner and the developing agent refluxed from the supply/convey member 45, and conveys the resultant material to the upstream side of the supply/convey member 45.

The peeling convey roller 47 is placed near a developing agent peeling magnetic pole S2 of the developing agent carrier 41. The peeling convey roller 47 is constituted by a rotatable rotating member (sleeve) 47A and a columnar magnetic member 47B housed in the rotating member 47A and fixed on the developing device frame member 40.

The recovery/convey member 49 rotatably placed in a recovery section 403 receives and recovers the spent developing agent which is peeled by the peeling convey roller 47 and peeling plate 48 and falls. The recovery/convey member 49 conveys this developing agent to the outside of the image formation area of the developing agent carrier 41, which is located on the downstream side in the developing agent convey direction of the supply/convey member 45. Note that the recovered developing agent may be charged into an area corresponding to the developing area of the developing agent carrier 41 which is located on the downstream side in the developing agent convey direction of the supply/convey member 45 as long as this area is located at a position where no developing agent returns to the developing agent carrier 41. Alternatively, the spent developing agent recovered by the recovery/convey member 49 may be refluxed to the downstream or upstream side in the developing agent convey direction of an agitation/convey section 402.

The supply/convey member 45, agitation/convey member 46, and recovery/convey member 49 each convey a developing agent in the rotation axis direction while agitating it, and discharge the developing agent in a direction almost perpendicular to the rotation axis.

The developing device frame member 40 is comprised of a lower frame member 40A which supports the developing agent carrier 41, peeling convey roller 47, supply member 44, supply/convey member 45, and agitation/convey member 46, an intermediate frame member 40B which supports the peeling plate 48 and recovery/convey member 49, and an upper lid 40C which closes the upper opening portion of the intermediate frame member 40B.

The lower frame member 40A forms the supply section 401 which houses the supply member 44 and supply/convey member 45 and the agitation/convey section 402 which houses the agitation/convey member 46. The supply section 401 and agitation/convey section 402 are formed on both sides of a first partition wall 404 which extends upright from the bottom portion of the lower frame member 40A and has a developing agent entrance/exit opening portion.

A second partition wall 405 formed on the bottom portion of the intermediate frame member 40B which rotatably supports the recovery/convey member 49 partitions the supply section 401 from the recovery section 403. A portion of the intermediate frame member 40B closes the upper opening portion of the agitation/convey section 402.

The downstream side of the recovery section 403 in the developing agent convey direction communicates with the downstream side of the supply section 401 in the developing agent convey direction through a first opening portion 406 formed near an end portion of the second partition wall 405.

The downstream side of the supply section 401 in the developing agent convey direction communicates with the upstream side of the agitation/convey section 402 in the developing agent convey direction through an opening portion (not shown) formed near one end portion of the first partition wall 404. The downstream side of the agitation/convey section 402 directly communicates with the upstream side of the supply section 401.

The developing agent peeled by the peeling convey roller 47 and peeling plate 48 is recovered into the recovery section 403. The recovered developing agent is conveyed to the developing agent conveyance downstream side by the recovery/convey member 49 and further refluxed to the supply section 401.

The developing agent in the supply section 401 is temporarily discharged by the supply/convey member 45 into the agitation/convey section 402 through an opening portion (not shown) formed in one end portion of the first partition wall 404, as indicated by an arrow W1. The developing agent discharged into the agitation/convey section 402 is mixed and agitated with the toner replenished from a toner replenishing unit 40T by the agitation/convey member 46 through a toner replenishment opening portion 409. The resultant material is conveyed to the downstream side in the convey direction of the agitation/convey member 46 and introduced into the supply section 401 through an opening portion (not shown) formed in the other end portion of the first partition wall 404, as indicated by an arrow W2. In the supply section 401, the supply/convey member 45 supplies the developing agent to the supply member 44 while conveying and discharging it in the axial direction. The supply member 44 supplies the developing agent to the developing agent carrier 41 while conveying and discharging it in the axial direction.

Reference symbol B(DC) denotes a DC bias power supply for applying a DC bias to the developing agent carrier 41; and B(AC), an AC bias power supply for applying an AC bias to the developing agent carrier 41. These power supplies are controlled by a control section (to be described later) such that an AC bias is superimposed on a DC bias to perform development.

The developing unit 4 of the image forming apparatus according to this embodiment performs development by using a two-component developing agent containing toner and a carrier.

As the toner, polymerized toner with a mass average particle diameter of 1 to 7 μm is used. The use of polymerized toner makes it possible to perform image formation with high resolution, stable density, and very little fog.

Polymerized toner is manufactured by the following manufacturing method.

A toner binder resin and toner are obtained by polymerization of a raw monomer or pre-polymer for a binder resin and a subsequent chemical treatment. More specifically, they are obtained by a polymerization reaction such as suspension polymerization or emulsion polymerization and, if required, a fusion process between particles. Polymerized toner is manufactured by polymerizing a raw monomer or pre-polymer after uniformly dispersing it in a water-based solution. Therefore, the obtained toner is uniform in particle size distribution and shape.

In this embodiment, polymerized toner with a mass average particle diameter of 1 to 7 μm is used.

A mass average particle diameter is a mass-based average particle diameter. This value was measured by "Coulter Counter TA-II" or "Coulter Multisizer" (both available from Coulter) having a wet-type sparger.

As the mass average particle diameter decreases below 1 μm, fog and toner scattering tend to occur. The upper limit, 7 μm, is the upper limit of particle diameters which can realize high image quality that is an object of this embodiment.

With a reduction in the particle diameter of toner, a carrier formed from magnetic particles with a mass average particle diameter of 20 to 70 μm and a magnetization quantity of 20 to 70 emu/g is preferably used. A carrier with a particle diameter of less than 20 μm tends to cause carrier adhesion. With the use of a carrier having a particle diameter exceeding 70 μm, an image with uniform density may not be formed.

Figure 4:
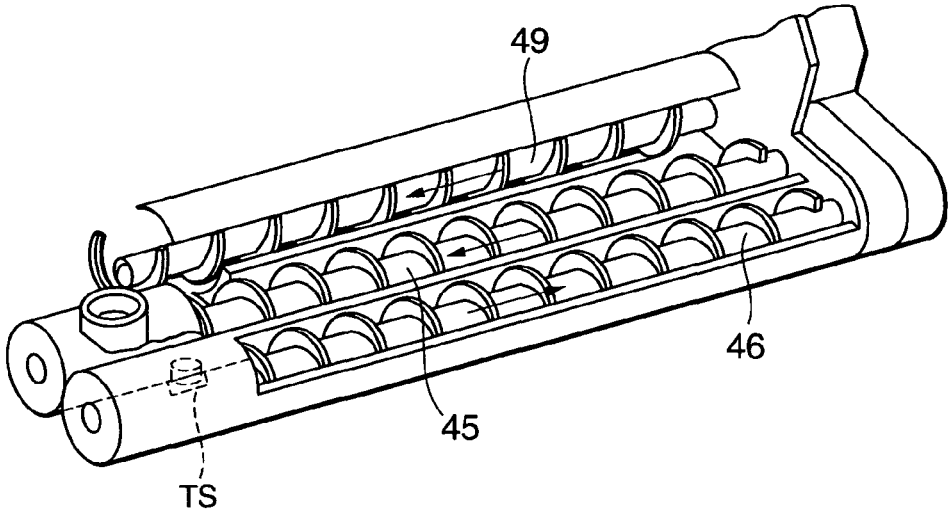
FIG. 4 is a perspective view showing the installation position of a toner density sensor in a developing unit.

FIG. 4 is a perspective view showing the installation position of a toner density sensor TS in the developing unit 4.

The two axes of the supply/convey member 45 and agitation/convey member 46 are located parallel to form the first convey section, in which a developing agent is conveyed in the directions indicated by the arrows while being rotated. The recovery/convey member 49 (second conveyor screw) is placed above the supply/convey member 45 (first conveyor screw) for conveying a developing agent in the direction indicated by the arrow, with their axes being kept parallel. These members convey the developing agent in the same direction.

Development is performed in the development area to consume toner. The developing agent after the development processing falls from the end face of the second conveyor screw 49 for recovering/conveying the developing agent used for the development processing, which is located on the downstream side in the developing agent convey direction, onto a portion located slightly upstream of the end face of the first conveyor screw 45 in the developing agent convey direction. The developing agent then merges with the developing agent conveyed by the first conveyor screw 45. The toner density sensor TS for detecting a toner density by detecting the permeability of a developing agent is installed at a position which is located slightly downstream of the confluence in the developing agent convey direction and at which the sensor opposes the first conveyor screw 45. The toner density sensor TS is used to detect a toner density.

When a two-component developing agent constituted by polymerized toner with a small particle diameter and a carrier with a small particle diameter is used to realize high image quality, the fluidity of the developing agent decreases. As a consequence, the toner density detection precision tends to decrease. When the toner density sensor has good sensitivity (a rate of change in output per mass % of toner density: V/mass %), toner density controllability becomes stable. If, for example, the sensitivity of the toner density sensor improves to 0.6 V/mass % as compared with 0.3 V/mass %, the use of the detected toner density value makes it possible to decrease the control range of toner in the developing device to ½ or less. That is, for example, toner density control, which has been done with variations of 0.6 mass % or more, can be done with variations of 0.3 mass % or less.

According to the present invention, as a result of various experiments, conditions could be obtained, under which a toner density can be detected by the toner density sensor TS facing the supply/convey member 45 with high detection precision.

Figure 5:
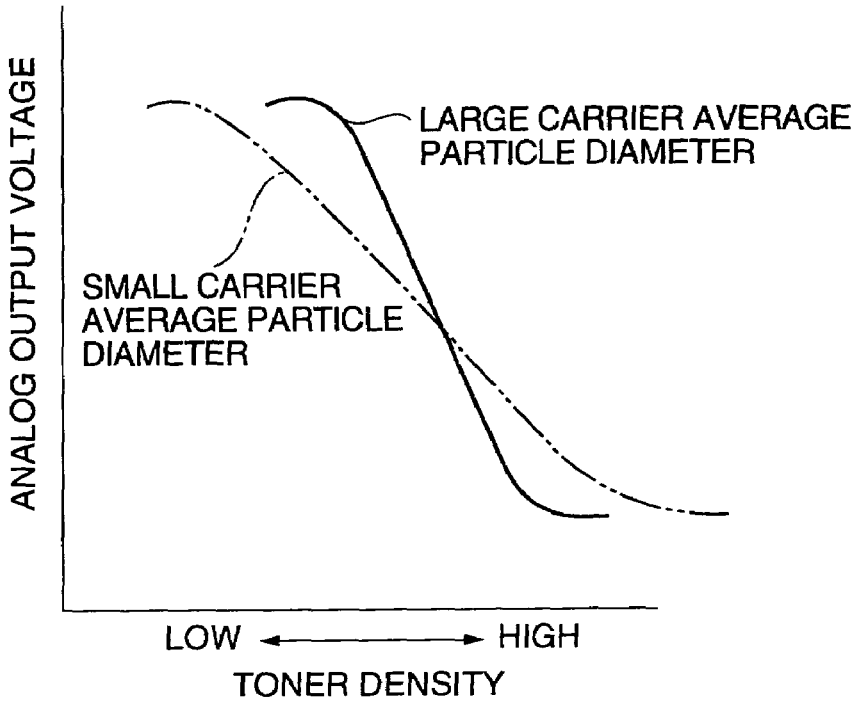
FIG. 5 is a graph showing the relationship between the output voltage from a permeability sensor and the toner density.

The toner density sensor TS used in the present invention is a permeability sensor which converts a change in apparent permeability due to a change in mixing ratio between a magnetic carrier and nonmagnetic toner into an electrical signal as an analog or digital output. The graph of FIG. 5 shows an example of the output state of the permeability sensor. FIG. 5 shows how the detection precision of the permeability sensor changes with a change in the carrier average particle diameter of a developing agent.

Figure 6:
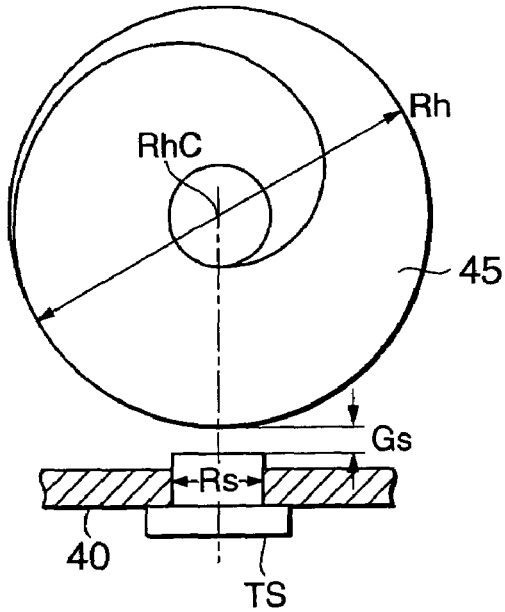
FIG. 6 is a schematic view showing the positional relationship between a convey member and the toner density sensor in the developing unit.

FIG. 6 shows the position of the supply/convey member 45 relative to the toner density sensor TS which is placed to oppose it. The toner density sensor TS has a head surface with a diameter Rs. The perpendicular bisector of the head surface passes through a central axis RhC of the supply/convey member 45. The toner density sensor TS is in a non-contact state with respect to the supply/convey member 45 with a screw diameter Rh, and opposes it through a gap Gs.

EXPERIMENTAL EXAMPLE 1

Figure 7:
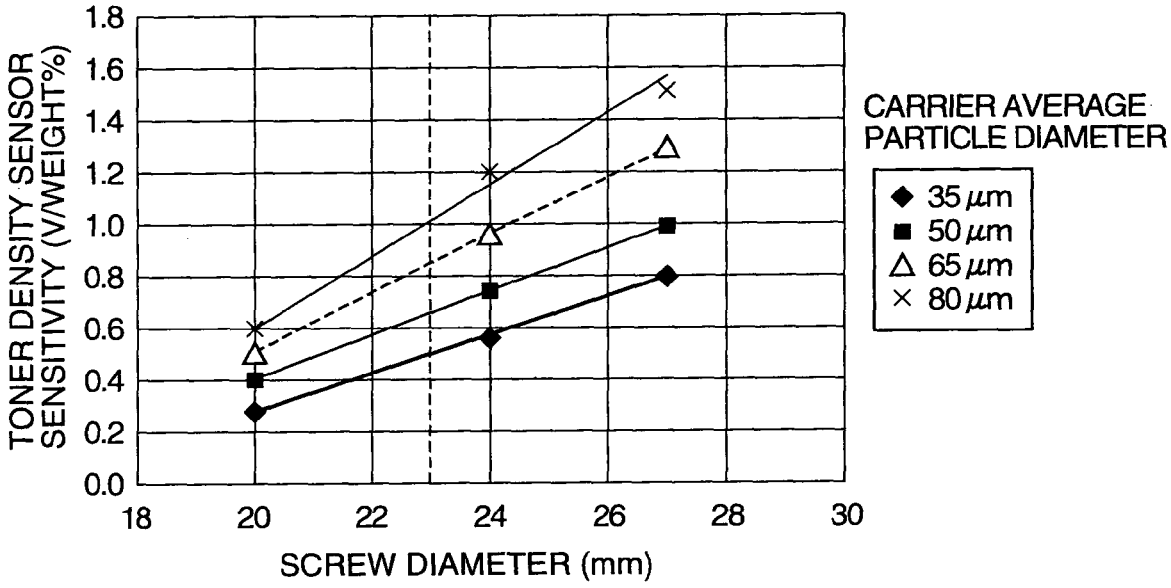
FIG. 7 is a graph showing the relationship between the screw diameter and the sensitivity of the toner density sensor.

The present inventors prepared a plurality of supply/convey members 45 with different screw diameters and different screw pitches, and conducted experiments on sensor sensitivity under the conditions that the gaps Gs between the supply/convey members 45 and the toner density sensors TS were set to a predetermined value (0.5 mm in this embodiment), the rotational speeds of the supply/convey members 45 were made to differ from each other, and a two-component developing agent containing polymerized toner was used. As a result of the experiments, it was confirmed that the rotational speeds and screw pitches of the supply/convey members 45 had small influences on sensitivity, but the screw diameters Rh had large influences on sensitivity. Although the screw diameters Rh of the conventional mainstream supply/convey member 45 are about 16 mm to 20 mm, experiments were conducted by preparing supply/convey members 45 with larger screw diameters. The graph of FIG. 7 shows test results on the screw diameters Rh and toner density sensitivities.

The experiments were conducted on two-component developing agents containing polymerized toner with carrier mass average particle diameters of 35 μm, 50 μm, 65 μm, and 80 μm as four kinds of parameters under the condition that toner densities were set with respect to the respective carrier average particle diameters so as to make the coverages with respect carrier surface areas become almost equal.

Obtaining a toner density sensor sensitivity of 0.5 V/mass % or more indicates that variations in toner density control can be suppressed within a variation width of 0.5% or less. For this reason, the screw diameter Rh with which the sensor sensitivity became 0.5 V/mass % was obtained when a developing agent with a carrier mass average particle diameter of 35 μm with which the toner density sensor TS exhibited the lowest sensitivity was used. The resultant screw diameter Rh was 23 mm.

According to the present invention, the screw diameter Rh of the supply/convey member 45 which the toner density sensor TS opposes is set to 23 mm or more. Satisfying this condition allows the toner density sensor TS to detect a toner density sensor TS with a required sensor sensitivity of 0.5 V/mass % or more.

According to Experimental Example 1, in the developing units 4 for the respective colors, i.e., Y, M, C, and K, in the image forming apparatus described with reference to FIGS. 1 and 2, the supply/convey members 45 with the screw diameters Rh of 23 mm or more and screw pitches of 16 to 35 mm are used, and developing agents are conveyed at rotational speeds of 3 to 10 rps. The control block diagram of FIG. 8 shows the relationship of control between toner density detection by the toner density sensor TS used in this arrangement and toner replenishment by a control section C1.

The control section C1 compares a detection output value from the toner density sensor TS with the threshold recorded on a memory, and replenish toner from the toner replenishing unit 40T on the basis of the comparison result. This toner replenishment control allows accurate toner replenishment without variations and ensures stable toner density control.

Figure 8:
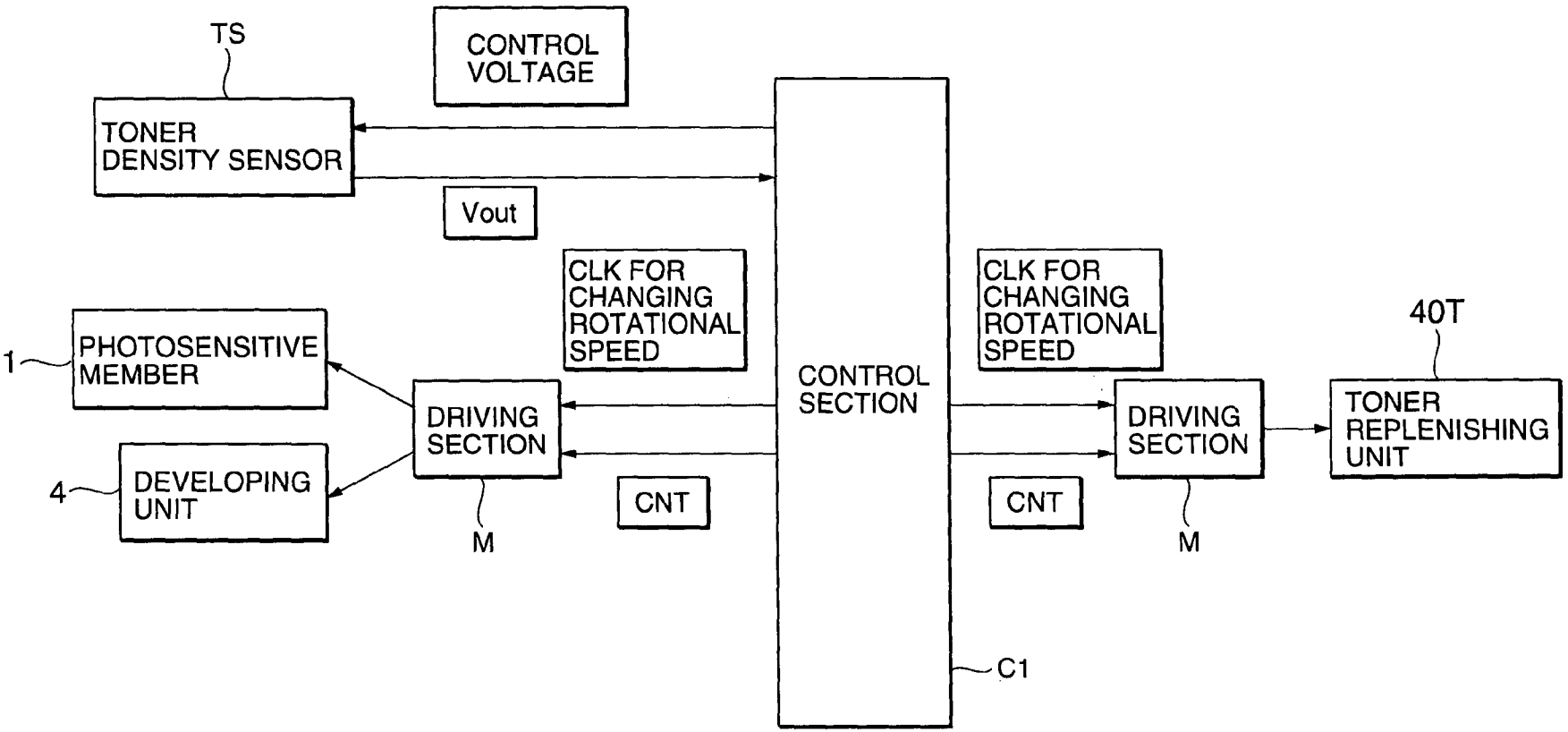
FIG. 8 is a control block diagram concerning toner density detection and toner replenishment.

As shown in FIG. 8, when the photosensitive body 1 and developing unit 4 are driven by a single driving section M, the rotational speeds of the respective sections of the developing unit 4 change as the linear speed of the photosensitive body 1 changes, and the toner density read cycle is also changed. Assume that the photosensitive body 1 and developing unit 4 are to be rotated by different driving sections. In this case, when the linear speed of the photosensitive body 1 is to be changed, the control section issues an instruction to change the speed of the developing agent carrier 41 so as to change the rotational speed of the developing agent carrier 41. In accordance with this operation, the rotational speeds of the first and second conveyor screws 45 and 49 change, and the toner density read cycle changes.

The execution of the above toner density detection greatly improves the detection precision to reduce variations in detection value to an unrecognizable degree. More specifically, when a toner density is detected by the present invention with a sensor sensitivity of 0.5 V/mass % or more being held, variations in detection by the toner density sensor TS can be suppressed within 0.5%.

EXPERIMENTAL EXAMPLE 2

It is obvious from the test results shown in the graph of FIG. 7 that the sensitivity of the toner density sensor TS decreases with a reduction in carrier average particle diameter, and increases with an increase in the screw diameter Rh of the supply/convey member 45.

As the screw diameter Rh of the supply/convey member 45 increases, the sensor sensitivity increases. However, the use of the supply/convey member 45 with the large screw diameter Rh increases the size of the developing unit 4, and hence the size of the image forming apparatus. It is therefore undesirable to increase the screw diameter Rh more than required to obtain a necessary sensor sensitivity.

Figure 9:
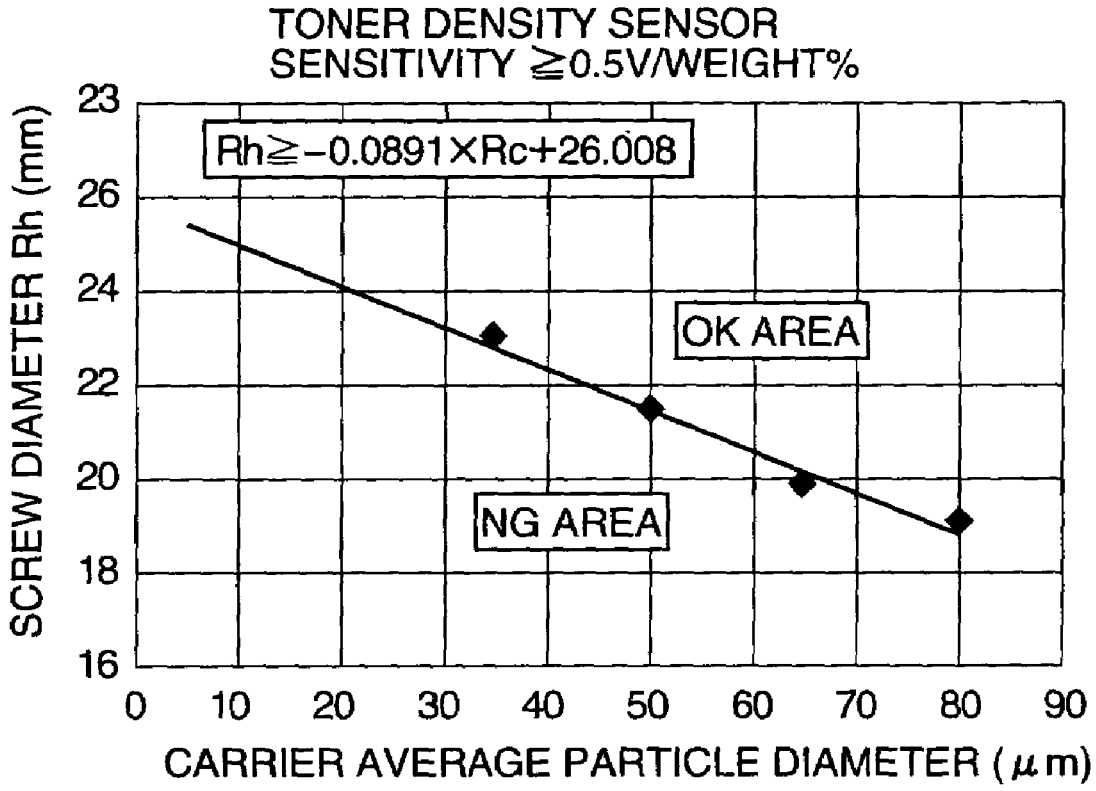
FIG. 9 is a graph showing the relationship between the carrier average particle diameter and the screw diameter.

A sensor sensitivity of 0.5 V/mass % or more is recognized as a sufficient sensitivity for toner density control. Therefore, the graph of FIG. 9 shows the experimental results obtained by obtaining the screw diameters Rh with which a sensor sensitivity of 0.5 V/mass % was obtained when the carrier average particle diameter of a developing agent in use was changed to 35 μm, 50 μm, 65 μm, and 80 μm.

The present invention is derived from such test results. The relationship between the carrier average particle diameter Rc (μm) of a two-component developing agent and the diameter Rh (mm) of the supply/convey member 45 is set to satisfy $$Rh - 0.0891 \times Rc + 26.008 \quad (1)$$

If, for example, a developing agent whose carrier average particle diameter Rc is 35 μm is used, the screw diameter Rh needs to be set to 23 mm or more. If the carrier average particle diameter is 80 μm, the screw diameter Rh needs to be set to 19 mm or more.

According to Experimental Example 2, in the developing units 4 for the respective colors, i.e., Y, M, C, and K, in the image forming apparatus described with reference to FIGS. 1 and 2, the supply/convey members 45 with the screw diameters Rh satisfying inequality (1) with respect to developing agents to be used and screw pitches of 16 to 35 mm are used, and developing agents are conveyed at rotational speeds of 3 to 10 rps. The control block diagram of FIG. 8 shows the relationship of control between toner density detection by the toner density sensor TS used in this arrangement and toner replenishment by the control section C1.

The control section C1 compares a detection output value from the toner density sensor TS with the threshold recorded on a memory, and replenish toner from the toner replenishing unit 40T on the basis of the comparison result. This toner replenishment control allows accurate toner replenishment without variations and ensures stable toner density control.

As shown in FIG. 8, when the photosensitive body 1 and developing unit 4 are driven by the single driving section M, the rotational speeds of the respective sections of the developing unit 4 change as the linear speed of the photosensitive body 1 changes, and the toner density read cycle is also changed. Assume that the photosensitive body 1 and developing unit 4 are to be rotated by different driving sections. In this case, when the linear speed of the photosensitive body 1 is to be changed, the control section issues an instruction to change the speed of the developing agent carrier 41 so as to change the rotational speed of the developing agent carrier 41. In accordance with this operation, the rotational speeds of the first and second conveyor screws 45 and 49 change, and the toner density read cycle changes.

The execution of the above toner density detection greatly improves the detection precision to reduce variations in detection value to an unrecognizable degree. More specifically, when a toner density is detected by the present invention with a sensor sensitivity of 0.5 V/mass % or more being held, variations in detection by the toner density sensor TS can be suppressed within 0.5%.

EXPERIMENTAL EXAMPLE 3

The present inventors conducted various experiments on factors that affect the sensor sensitivity of the toner density sensor TS. As a result, a strong significance was recognized between the head diameter Rs of the toner density sensor TS and the carrier average particle diameter.

Figure 10A:
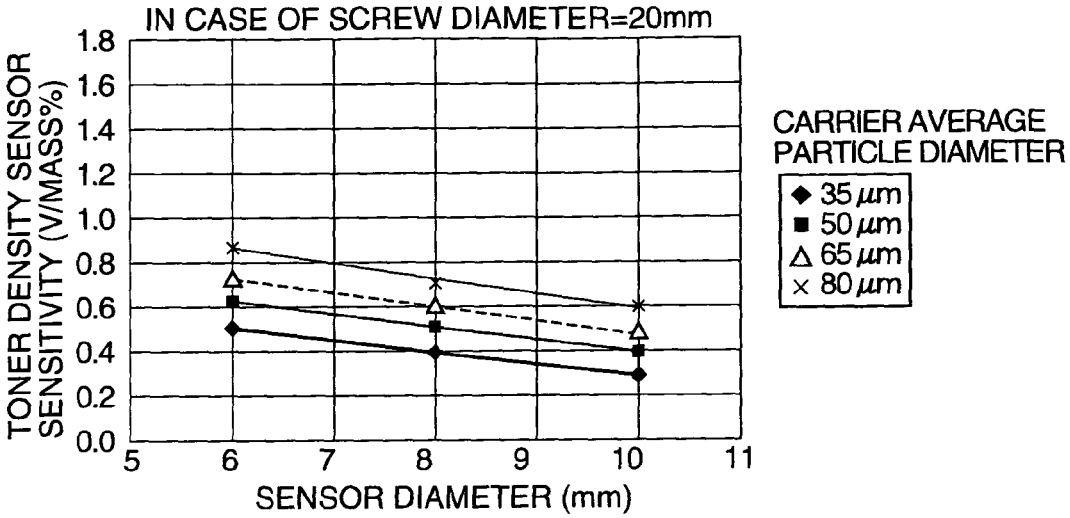
FIGS. 10A to 10C are graphs each showing the relationship between the diameter of the toner density sensor and the sensitivity of the toner density sensor for each screw diameter.
Figure 10B:
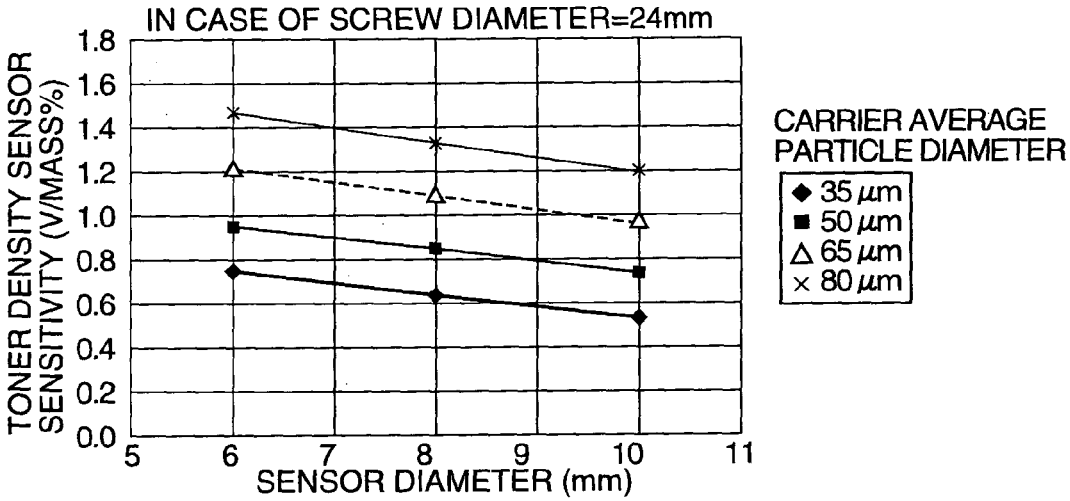
Figure 10C:
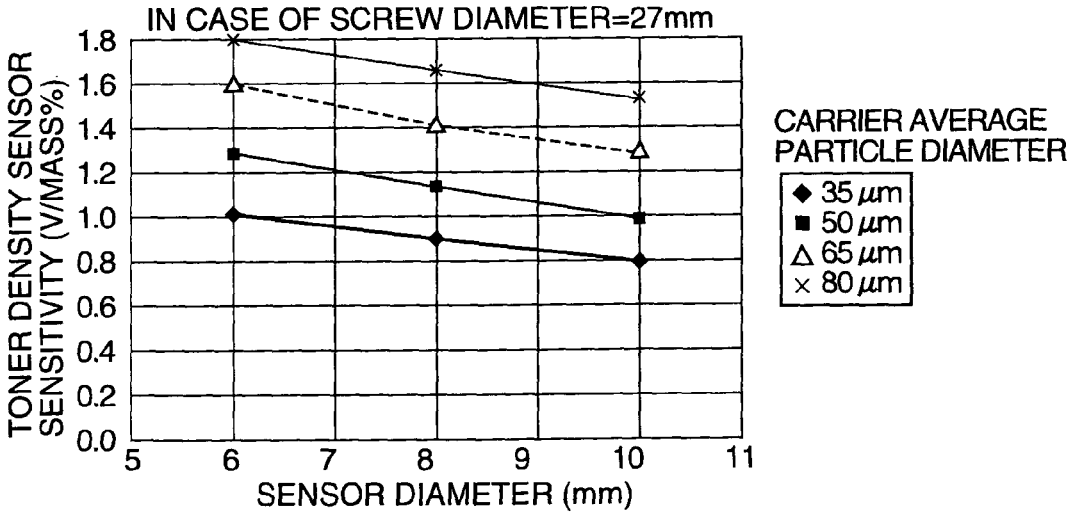
Figure 11:
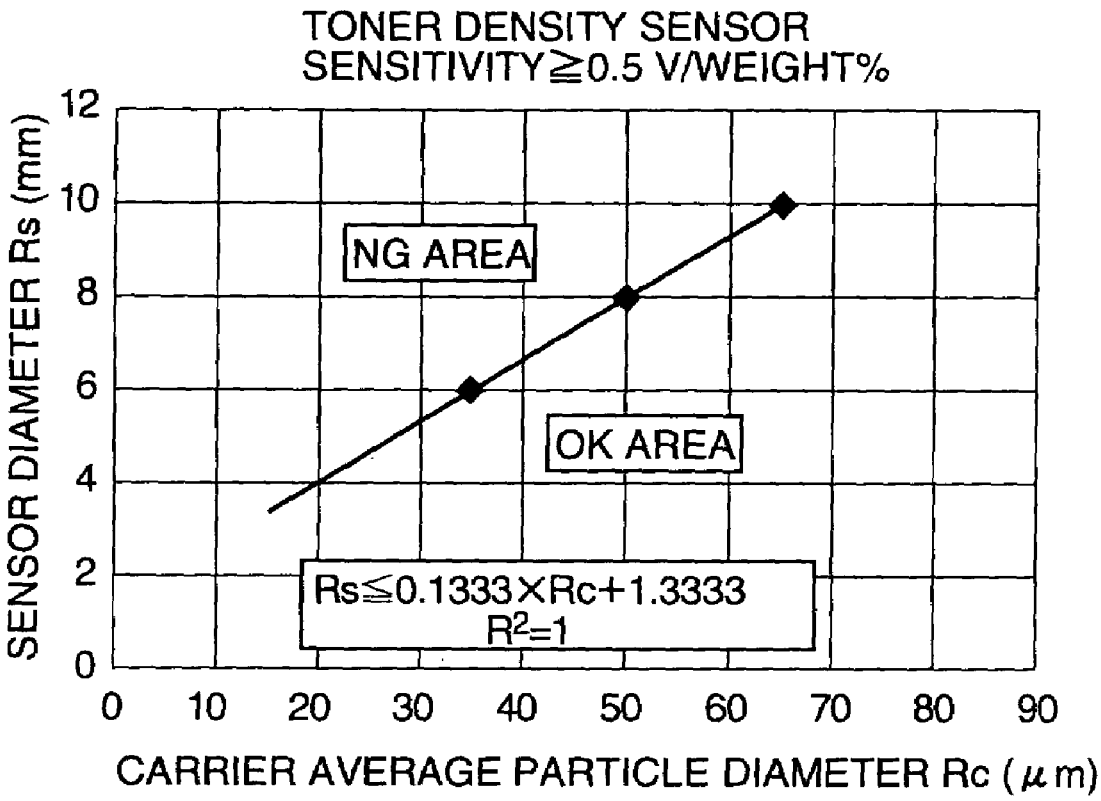
FIG. 11 is a graph showing the relationship between the carrier average particle diameter and the diameter of the toner density sensor.

FIGS. 10A to 10C are graphs each showing the relationship between the head diameter Rs of the toner density sensor and the sensitivity of the toner density sensor. FIG. 10A shows the relationship in a case wherein the screw diameter Rh of the supply/convey member 45 is 20 mm. FIG. 10B shows the relationship in a case wherein the screw diameter Rh of the supply/convey member 45 is 24 mm. FIG. 10C shows the relationship in a case wherein the screw diameter Rh of the supply/convey member 45 is 27 mm. FIGS. 10A to 10C are graphs each showing changes in the diameter Rs and sensor sensitivity when developing agents with carrier average particle diameters of 35 μm, 50 μm, 65 μm, and 80 μm are used. FIG. 11 shows the relationship between the head diameter Rs of the toner density sensor and the carrier average particle diameter Rc, obtained on the basis of the results shown in FIGS. 10A to 10C, with which a sensor sensitivity of 0.5 V/mass % or more can be obtained.

The present invention is derived from such test results. The relationship between the carrier average particle diameter Rc (μm) of a two-component developing agent and the head diameter Rs (mm) of the toner density sensor TS opposing the supply/convey member 45 is set to satisfy $$Rs\ 0.1333\times Rc+1.3333 \quad (2)$$

If, for example, a developing agent whose carrier average particle diameter Rc is 35 μm is used, the head diameter Rs needs to be set to 6 mm or less. If the carrier average particle diameter Rc is 50 μm, the head diameter Rs needs to be set to 8 mm or less.

According to Experimental Example 3, in each of the developing units 4 for the respective colors, i.e., Y, M, C, and K, in the image forming apparatus described with reference to FIGS. 1 and 2, the toner density sensor TS is placed in a non-contact state to oppose the supply/convey member 45 with a gap of 0.8 mm or less, and the head diameter Rs of the toner density sensor TS is set to satisfy inequality (2) with respect to the carrier average particle diameter Rc of the developing agent to be used. FIG. 8 shows the relationship of control between toner density detection by the toner density sensor TS and toner replenishment by the control section C1.

The control section C1 compares a detection output value from the toner density sensor TS with the threshold recorded on a memory, and replenish toner from the toner replenishing unit 40T on the basis of the comparison result. This toner replenishment control allows accurate toner replenishment without variations and ensures stable toner density control.

As shown in FIG. 8, when the photosensitive body 1 and developing unit 4 are driven by the single driving section M, the rotational speeds of the respective sections of the developing unit 4 change as the linear speed of the photosensitive body 1 changes, and the toner density read cycle is also changed. Assume that the photosensitive body 1 and developing unit 4 are to be rotated by different driving sections. In this case, when the linear speed of the photosensitive body 1 is to be changed, the control section issues an instruction to change the speed of the developing agent carrier 41 so as to change the rotational speed of the developing agent carrier 41. In accordance with this operation, the rotational speeds of the first and second conveyor screws 45 and 49 change, and the toner density read cycle changes.

The execution of the above toner density detection greatly improves the detection precision to reduce variations in detection value to an unrecognizable degree. More specifically, when a toner density is detected by the present invention with a sensor sensitivity of 0.5 V/mass % or more being held, variations in detection by the toner density sensor TS can be suppressed within 0.5%.

The present invention is not limited to the arrangement of the developing unit described with reference to FIGS. 2 and 3, and can be widely applied to image forming apparatuses using developing units with general arrangements designed to perform development using two-component developing agents.

What is claimed is:

1. An image forming apparatus including developing means for developing an electrostatic latent image on an image carrier by using a two-component developing agent containing polymerized toner, said developing means comprising:

a supply/convey member in the form of a spiral screw which conveys the two-component developing agent in an axial direction while agitating the developing agent; and a toner density sensor which is placed to oppose said supply/convey member and detects a toner density of the two-component developing agent, wherein a relationship between a carrier average particle diameter Rc (μm) of the two-component developing agent and a head diameter Rs (mm) of said toner density sensor satisfies $$Rs \leqq 0.13333\times Rc+1.3333.$$

2. An apparatus according to claim 1, wherein when said supply/convey member has a screw pitch of 16 to 33 mm, the rotational speed of said supply/convey member is 3 to 10 rps.

3. An apparatus according to claim 1, wherein said toner density sensor comprises a sensor which detects a change in permeability.

4. An apparatus according to claim 1, wherein a perpendicular bisector of a head surface of said toner density sensor passes through a central axis of said supply/convey member.

5. An apparatus according to claim 1, wherein said supply/convey member is in a non-contact state with respect to the head surface of said toner density sensor, and a gap therebetween is not more than 0.8 mm.

6. An apparatus according to claim 1, wherein said carrier average particle diameter Rc (μm) is not more than 50 μm and not less than 20 μm.

* * * * *